US008020843B2

(12) United States Patent
Wang

(10) Patent No.: US 8,020,843 B2
(45) Date of Patent: Sep. 20, 2011

(54) CLAMPING FIXTURE

(75) Inventor: Xiao-Jie Wang, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 981 days.

(21) Appl. No.: 11/938,304

(22) Filed: Nov. 12, 2007

(65) Prior Publication Data

US 2009/0121404 A1 May 14, 2009

(51) Int. Cl.
*B25B 1/24* (2006.01)

(52) U.S. Cl. ..... 269/266; 269/268; 269/43; 269/45

(58) Field of Classification Search ..... 269/266, 269/268, 43, 45, 250, 139, 71, 73, 105, 109; 248/49, 74.1, 223.41, 346.06; 144/2.1, 3.1, 144/253.1, 253.4, 253.6; 83/452, 465, 467.1, 83/468.7

See application file for complete search history.

(56) References Cited

U.S. PATENT DOCUMENTS

| | | | | | |
|---|---|---|---|---|---|
| 217,364 | A * | 7/1879 | Goss | 269/251 |
| 902,230 | A * | 10/1908 | Holland | 269/40 |
| 2,595,235 | A * | 5/1952 | Emrich | 269/43 |
| 2,691,817 | A * | 10/1954 | Rainone et al. | 29/235 |
| 2,776,683 | A * | 1/1957 | Cowley | 269/246 |
| 2,883,728 | A * | 4/1959 | Sederlund | 249/50 |
| 2,908,303 | A * | 10/1959 | Schmidt, Jr. | 269/10 |
| 2,932,995 | A * | 4/1960 | Durfee | 408/115 R |
| 3,052,461 | A * | 9/1962 | Bateman | 269/43 |
| 3,297,313 | A * | 1/1967 | Stevens | 269/71 |
| 3,434,400 | A * | 3/1969 | Hochfeld | 493/417 |
| 3,743,566 | A * | 7/1973 | Louthan et al. | 156/499 |
| 3,877,690 | A * | 4/1975 | Owens | 269/265 |
| 3,982,739 | A * | 9/1976 | Maes | 269/37 |
| 4,080,858 | A * | 3/1978 | Stolzer | 83/247 |
| 4,427,191 | A * | 1/1984 | Hess | 269/43 |
| 4,650,379 | A * | 3/1987 | Jaskolski | 409/220 |
| 5,094,435 | A * | 3/1992 | Depperman et al. | 269/43 |
| 5,330,216 | A * | 7/1994 | Schnell | 269/45 |
| 5,387,287 | A * | 2/1995 | Reiter et al. | 118/503 |
| 5,468,177 | A | 11/1995 | Kindler et al. | |
| 5,595,378 | A * | 1/1997 | Martinsson et al. | 269/210 |
| 5,727,778 | A * | 3/1998 | Nodar | 269/43 |
| 6,062,553 | A * | 5/2000 | Strehl | 269/43 |
| 6,105,948 | A * | 8/2000 | Young | 269/43 |
| 6,179,279 | B1 * | 1/2001 | Asai et al. | 269/164 |
| 6,206,354 | B1 * | 3/2001 | Lin | 269/43 |
| 6,361,035 | B1 * | 3/2002 | Collins | 269/45 |
| 6,554,265 | B2 * | 4/2003 | Andronica | 269/268 |
| 7,207,363 | B1 * | 4/2007 | Liu et al. | 144/253.6 |
| 2002/0157515 | A1 * | 10/2002 | Dick | 83/438 |
| 2003/0034602 | A1 * | 2/2003 | Kavanaugh | 269/45 |

* cited by examiner

*Primary Examiner* — George Nguyen
(74) *Attorney, Agent, or Firm* — Altis Law Group, Inc.

(57) ABSTRACT

A clamping fixture is provided for mounting work pieces. The clamping fixture includes a base, a supporting member, a covering member, and a positioning member. The supporting member and the positioning member are attached to the base. The work piece is clamped by the covering member and the supporting member. The positioning member is used for changing its position with respect to the base and fixedly mounted thereby for abutting against the work pieces.

15 Claims, 8 Drawing Sheets

CLAMPING FIXTURE

BACKGROUND

1. Field of the Invention

The present invention generally relates to clamping fixtures, and particularly, to a clamping fixture capable of clamping work pieces with various sizes.

2. Description of Related Art

In abrasive machining process, mechanical work pieces are firmly clamped by a fixture. A conventional clamping fixture 900, shown in FIG. 8, is used for holding cylindrical work pieces 930. The clamping fixture 900 includes a supporting member 920 and a pressing member 910 supported on the supporting member 920. The pressing member 910 defines a plurality of first V-shaped slots 918 at a bottom side thereof. The first slots 918 are parallel and uniformly spaced with each other. The supporting member 920 defines a plurality of second V-shaped slots 928 at a top side thereof. The second slots 928 are also parallel and uniformly spaced with each other so as to correspond to the first slots 918.

In use, work pieces 930 are positioned in the second slots 928. Then the pressing member 910 is pressed downwardly to cover the supporting member 920 with the first slots 918 opposite to the second slot 928. Thereby, the work pieces 930 are firmly held in the clamping fixture 900.

However, work pieces may come in different sizes with different lengths and/or different diameters and the clamping fixture 900 is suitable for work pieces with a predetermined size.

Therefore, what is needed in the industry is to provide a clamping fixture adapted to clamping work pieces, which may have different lengths and/or different diameters.

SUMMARY

Accordingly, a clamping fixture is provided. The clamping fixture includes a base, a supporting member, a pressing member, and a positioning member. The supporting member and the positioning member are both attached to the base. The work piece is chucked by the pressing member and the supporting member. The positioning member is configured for changing its position relative to the base and fixedly mounted thereby for abutting the work pieces having different lengths.

DETAILED DESCRIPTION

Figure 1:
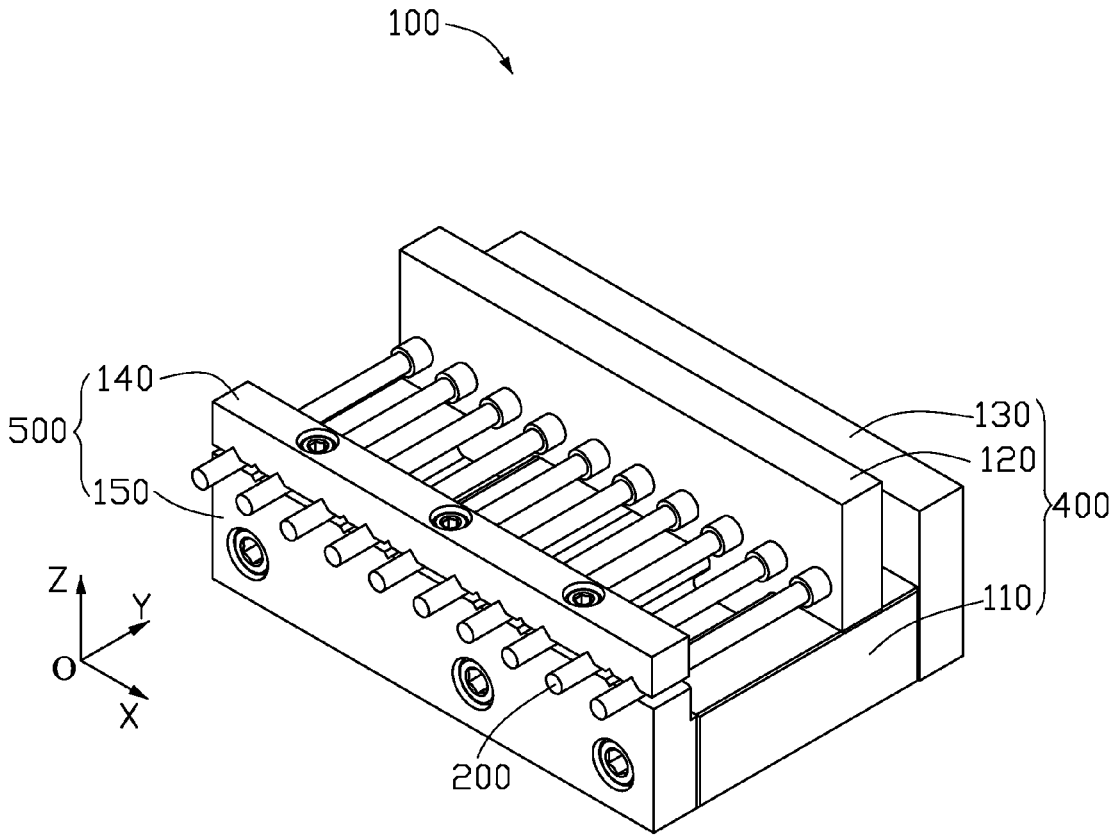
FIG. 1 is a perspective view of a clamping fixture in accordance with a preferred embodiment, the clamping fixture comprises a fastening mechanism and a positioning mechanism.

Referring to FIG. 1, a clamping fixture 100 is provided for clamping at least one work piece 200 for abrasive machining.

The work pieces 200 are cylindrical, and may have different lengths and/or different diameters. The clamping fixture 100 includes a positioning mechanism 400 and a clamping mechanism 500 coupled to the positioning mechanism 400. The positioning mechanism 400 is adjustable and configured for positioning the work pieces 200 in the clamping fixture 100 at an extending direction of the work piece 200. The clamping mechanism 500 is configured for holding the work pieces 200 in place.

Figure 2:
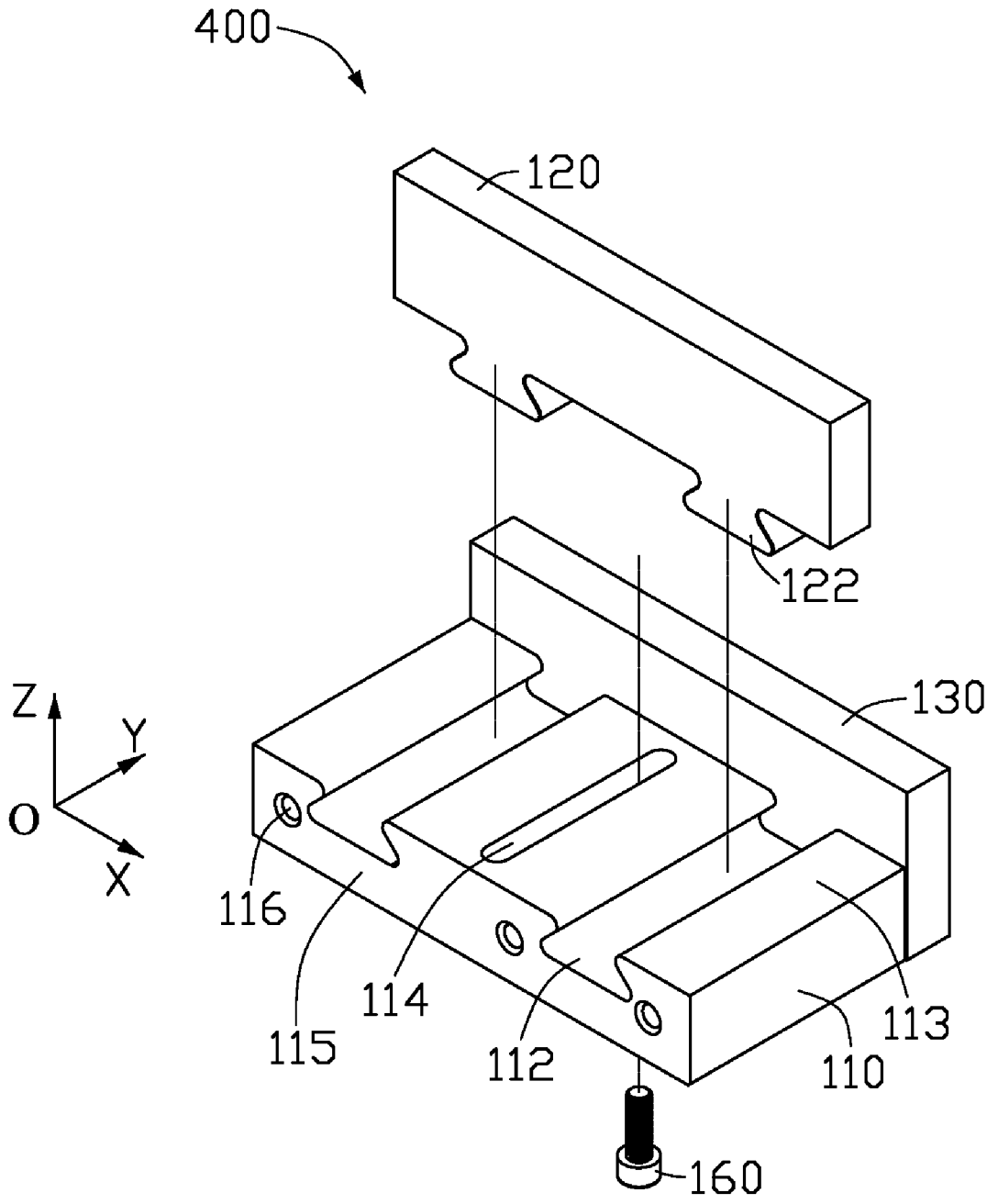
FIG. 2 is an isometric view of the positioning mechanism in FIG. 1, the positioning mechanism comprises a base and an positioning member.
Figure 3:
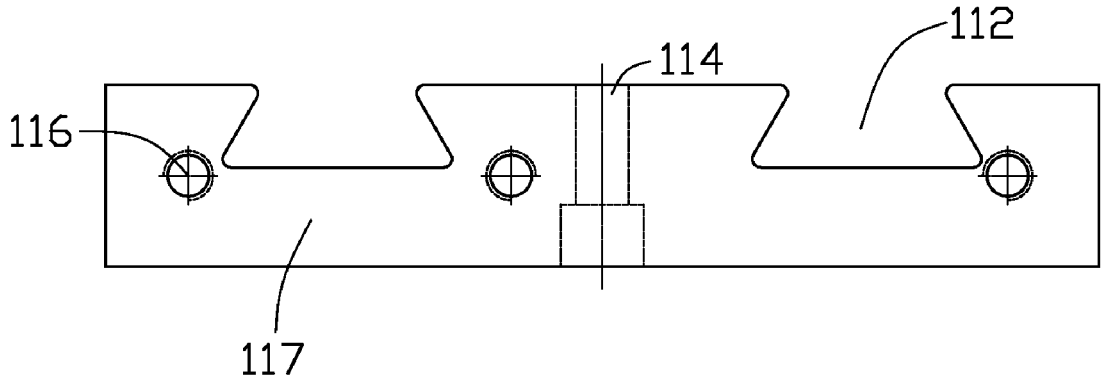
FIG. 3 is a front view of the base in FIG. 2.
Figure 4:
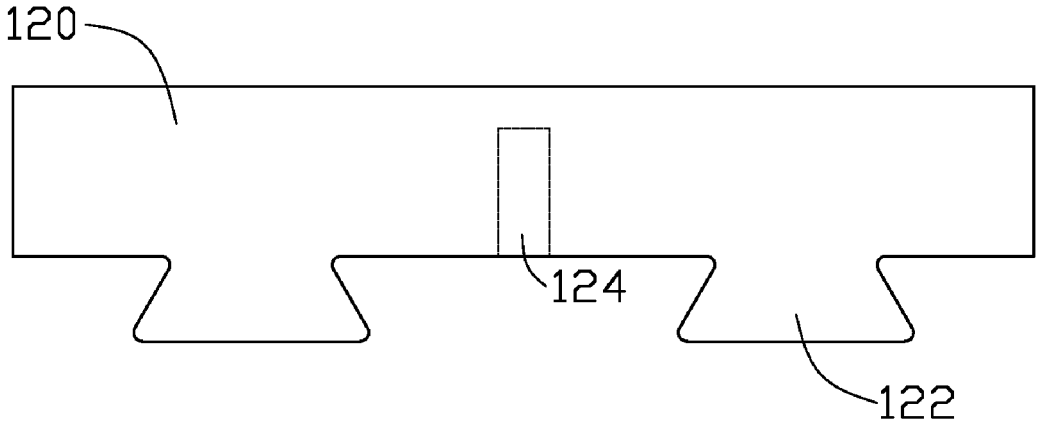
FIG. 4 is a front view of the positioning member in FIG. 2.

Referring to FIGS. 2 to 4, the positioning mechanism 400 includes a base 110, a positioning member 120, and a blocking member 130. The base 110 includes a platform 113 on a top surface connecting opposite side surfaces of the base 110, i.e. a first surface 115 and a second surface 117 (see FIG. 3). The first surface 115 and the second surface 117 are perpendicular to the platform 113. A plurality of threaded holes 116 are defined in the first surface 115 for attaching the clamping mechanism 500 to the base 110.

The platform 113 defines a pair of guiding grooves 112 communicating from the first surface 115 to the second surface 117. The guiding grooves 112 have dovetail shape taken along a plane parallel to the side surfaces 115 and 117. The platform 113 further defines a slot 114 communicating from the platform 113 to a bottom surface of the base 110 opposite to the platform 113. The slot 114 is parallel to and between the guiding grooves 112.

The positioning member 120 is slidably attached to the platform 113. A pair of protruding portions 122 extends from a bottom side of the positioning member 120. The structure of the protruding portions 122 corresponds to the guiding grooves 112 so as to fittingly mate with the grooves 112. A threaded hole 124 is defined in the bottom side of the positioning member 120 and between the pair of protruding portions 122 for fixing the positioning member 120 to the base 110.

In assembly of the positioning mechanism 400, the positioning member 120 is supported on the base 110 with the protruding portions 122 received in the grooves 112 and the threaded hole 124 aligned along the slot 114. Thus, the positioning member 120 is movable along an extending direction of the grooves 112. The positioning member 120 is selectively fixed on the base 110 by tightening a fastener 160 through the slot 114 and into the threaded hole 124. The blocking member 130 is attached to the second side surface 117 of the base 110. The blocking member covers the guide grooves in the second side surface 117 and extends beyond the second side surface 117. The blocking member is configured for preventing the positioning member 120 from sliding out of the grooves 112 at the second side surface 117.

Figure 5:
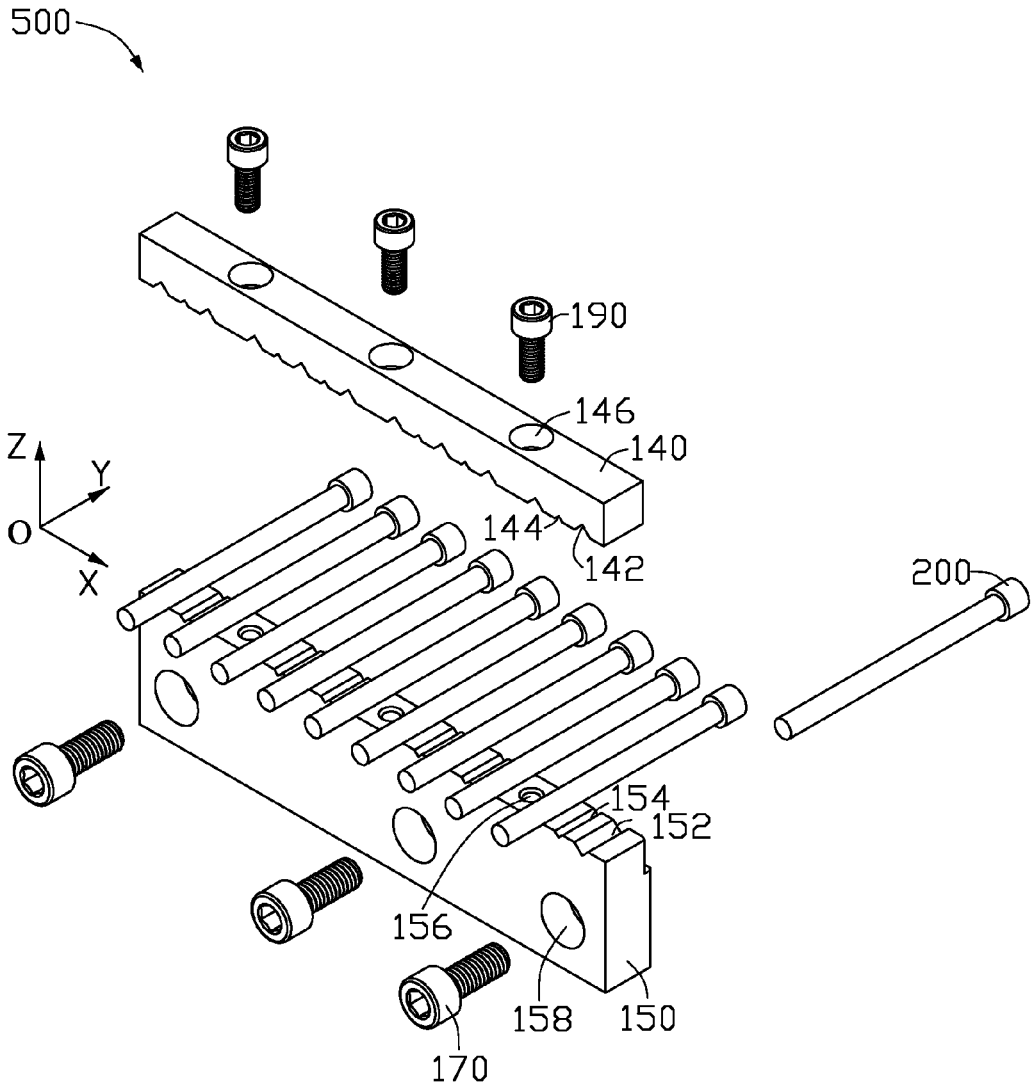
FIG. 5 is an isometric view of the fastening mechanism in FIG. 1, the fastening mechanism comprises a supporting member and a pressing member.
Figure 6:
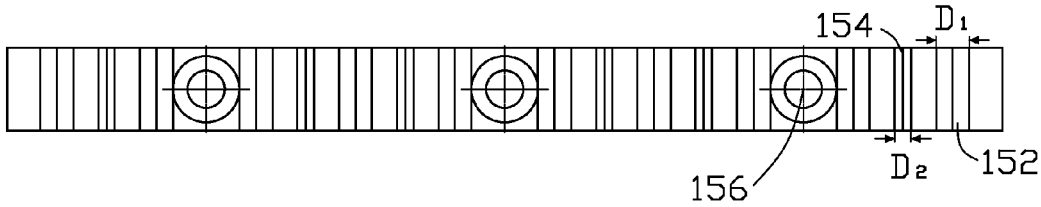
FIG. 6 is an above view of the supporting member in FIG. 5.
Figure 7:
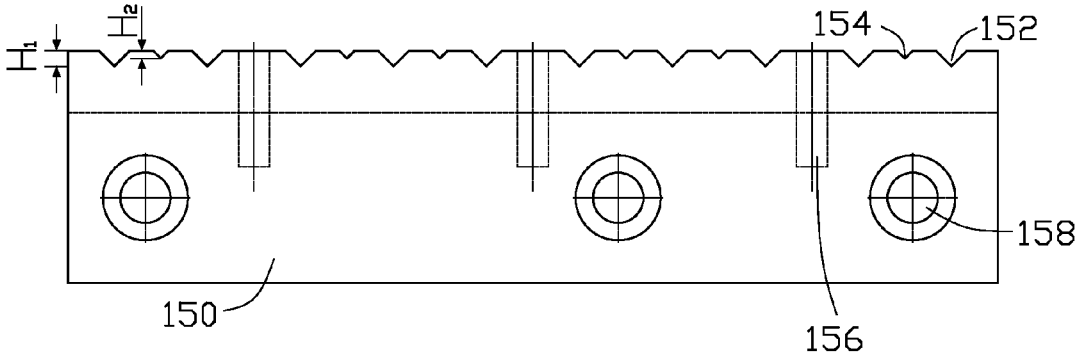
FIG. 7 is a front view of the supporting member in FIG. 5.
Figure 8:
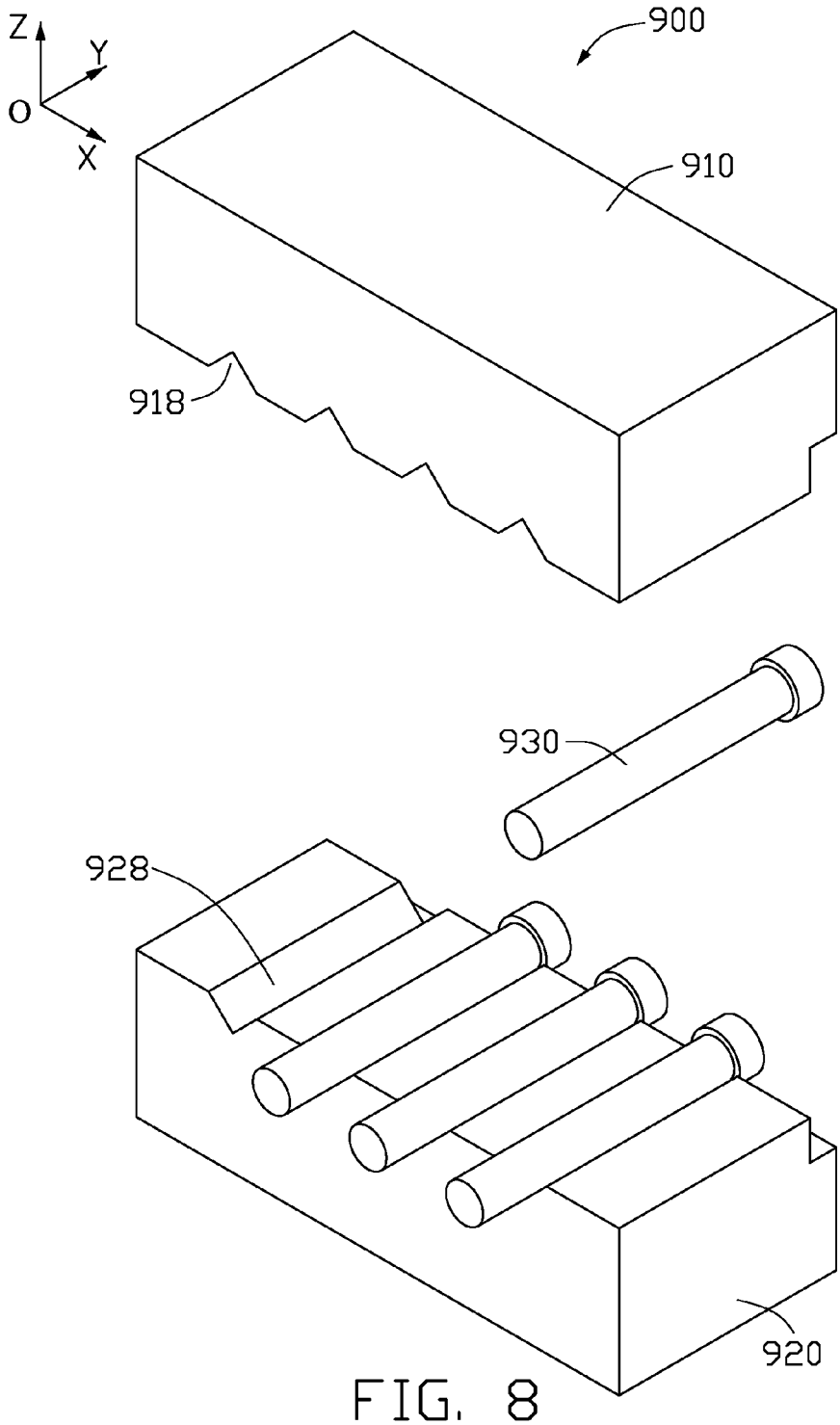
FIG. 8 (RELATED ART)
FIG. 8 is an isometric view of a conventional clamping fixture.

Referring to FIGS. 5 to 7, the clamping mechanism 500 includes an adjustable clamping member or pressing member 140, and a fixed clamping member or supporting member 150. The adjustable clamping member 140 is detachably coupled to the fixed clamping member 150. The fixed clamping member 150 is attached to the first side surface 115 of the base 110. A top surface 155 of the fixed clamping member 150 defines a plurality of first V-shaped slots 152 and a plurality of second V-shaped slots 154. The first slots 152 and the second slots 154 are formed in an alternating manner in the top surface 155. The first slots 152 and the second slots 154 are uniformly spaced and parallel with each other. Each of the first slots 152 has a width D1 and a depth H1 relative to the top surface 155, and is adopted for supporting the work piece 200 with a relatively small diameter. Each of the second slots 154 has a width D2 and a depth H2 relative to the top surface 155, and is adopted for supporting the work piece 200 with a relatively large diameter. A plurality of threaded holes 156 are defined in the top surface 155 for fixing the adjustable clamping member 140 to the fixed clamping member 150. A plurality of through holes 158 are defined in a side surface 157 of the fixed clamping member 150 for attaching the fixed clamping member 150 to the base 110.

The adjustable clamping member 140 has a length and a width that equal to that of the fixed clamping member 150. A plurality of third V-shaped slots 142 and fourth V-shaped slots 144 are formed in an alternating manner in a bottom side of the adjustable clamping member 140. The third slots 142 and the fourth slots 144 are uniformly spaced and parallel with each other. The third slots 142 and the fourth slots 144 are designed corresponding to the first slots 152 and the second slots 154 respectively. Each of the third slots 142 has a width D1 and a depth H1 that equal to the corresponding first slot 152. Each of the fourth slots 144 has a width D2 and a depth H2 that equal to the corresponding second slot 154. A plurality of through holes 146 are defined in the adjustable clamping member 140 for fixing the adjustable clamping member 140 to the fixed clamping member 150.

The operation of using the clamping fixture 100 for mounting work pieces 200 having different lengths and/or diameters will be described hereinafter. The fastener 160 is loosened, thereby allowing the positioning member 120 to be movable along the elongated slot 114. According to the length of the work piece 200, a predetermined position of the positioning member 120 with respect to the base 110 is selected. For example, each of the work pieces 200 is relatively longer, the position of the positioning member 120 would be located closer to the blocking member 130. The fastener 160 is then tightened, thus fixing the positioning member 120 at the predetermined position.

The work pieces 200 are correspondingly partially inserted into a predetermined slot according to the diameter of the work pieces 200. For example, the first slot 152 is selected for the work pieces 200 having relatively smaller diameter. Each of the work pieces 200 has one end abutting the positioning member 120. The adjustable clamping member 140 is then placed atop the work pieces 200 such that the slots of the adjustable clamping member 140 are aligned with the slots of the fixed clamping member 150 and partially inserted with the work pieces 200 correspondingly. Fasteners 190 are then screwed through the through holes 146 into the threaded holes 156, thus pushing the adjustable clamping member 140 against the work pieces 200 and clamping the work pieces 200 between the adjustable clamping member 140 and fixed clamping member 150. The work pieces 200 are tightly clamped and a grinding process can be performed on the first work pieces 200.

It should be noted that each of the work pieces 200 may have a shorter length or having a larger diameter. In this condition, the positioning member 120 is adjusted for being located slightly away from the blocking member 130 or closer to the adjustable clamping member 140. The second slots 154 and the corresponding fourth slots 144 are then selected for clamping the work pieces 200.

The foregoing description of the exemplary embodiments of the invention has been presented only for the purposes of illustration and description and is not intended to be exhaustive or to limit the invention to the precise forms disclosed. Many modifications and variations are possible in light of the above teaching. For example, the first slots 152 and the second slots 154 may be circular or arc shaped. Correspondingly, the third slots 142 and the fourth slots 144 may also be circular or arc shaped. The coupling mechanism for coupling the positioning member 120 to the base 110 may be designed with dovetail shaped grooves in the positioning member and corresponding protruding portions protruding from the base 110.

Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. A clamping fixture used for mounting at least a work piece having various shapes, the clamping fixture comprising:

a base defining an elongated groove, the elongated groove extending from one side to the other opposite side of the base;

a supporting member being attached to one side of the base, the supporting member defined with at least a first groove for supporting the work piece with a first shape;

a covering member being detachably coupled to the supporting member, the covering member covering the supporting member for clamping the work piece; and a positioning member being supported on the base, the positioning member formed with at least a protruding portion, the protruding portion having a structure to mate with the shape of the elongated groove, the protruding portion is moveable along the elongated groove, whereby the positioning member is slidable to different positions with respect to the base and abutting one end of the work piece where the positioning member is fixedly mounted to the base.

2. The clamping fixture as claimed in claim 1, wherein the elongated groove is dovetail shaped taken along a plane parallel with one of the side surfaces.

3. The clamping fixture as claimed in claim 1, wherein the supporting member is defined with at least a second groove with a configuration different from the first groove for supporting the work piece with a second shape different from the first shape.

4. The clamping fixture as claimed in claim 3, wherein the covering member is defined with at least a third groove and at least a fourth groove corresponding to the first groove and the second groove respectively, the first groove and the third groove are aligned together for clamping the first shaped work piece, the second groove and the fourth groove are aligned together for clamping the second shaped work piece.

5. The clamping fixture as claimed in claim 4, wherein the first groove, the second groove, the third groove, and the fourth groove have V-shaped configurations.

6. The clamping fixture as claimed in claim 1, wherein the supporting member extends beyond the base along a direction substantially perpendicular to the direction that the positioning member slides along.

7. The clamping fixture as claimed in claim 1, wherein the base is defined with an elongated slot in a substantially central portion, the elongated slot allows a bottom portion of the base to communicate with a top surface of the base, the positioning member is defined with a threaded hole for receiving a fastener, through the elongated slot, for fixedly mounting the positioning member to the base by tightening the fastener.

8. The clamping fixture as claimed in claim 1, wherein the clamping fixture further comprises a blocking member, the blocking member is attached to a side opposite to that of the supporting member.

9. The clamping fixture as claimed in claim 8, wherein the blocking member extends beyond the base along a direction substantially perpendicular to the direction that the positioning member slides along.

10. A clamping fixture for mounting work pieces having various shapes, the clamping fixture comprising:

a base defining at least a receiving slot;

a fastening mechanism configured for chucking a part of the peripheral surface of the work piece for preventing the work piece from moving; and a positioning mechanism configured for abutting an end portion of the work piece for positioning the work piece in the clamping fixture at a first position where the work piece having a first length and at a second position where the work piece having a second length different from the first length, the positioning member formed with at least a protruding portion, the protruding portion received in the receiving slot and capable of moving along the receiving slot.

11. The clamping fixture as claimed in claim 10, wherein the fastening mechanism comprises:

a fixed clamping member defining a first slot for supporting the work piece with a first diameter, and a second slot different from the first slot for supporting the work piece with a second diameter; and an adjustable clamping member detachably coupled to the fixed clamping for pressing the work piece.

12. The clamping fixture as claimed in claim 11, wherein the adjustable clamping member is defined with at least a third groove and at least a fourth groove corresponding to the first groove and the second groove respectively, the first groove and the third groove are aligned together for clamping the work piece with the first diameter, the second groove and the fourth groove are aligned together for clamping the work piece with the second diameter.

13. The clamping fixture as claimed in claim 10, wherein the receiving slot is dovetail shaped, and the protruding portion closely conforms to an interior configuration of the receiving slot.

14. The clamping fixture as claimed in claim 13, wherein the receiving slot is dovetail shaped, and the positioning member is slidable along the receiving slot.

15. A clamping fixture used for mounting work pieces having various shapes, the clamping fixture comprising:

a base defining at least one receiving slot in the top surface thereof;

a supporting member defining with a first supporting area for supporting the work piece with a first shape and a second supporting area for supporting the work piece with a second shape, the supporting member being attached to one side of the base, the supporting member above a top surface of the base;

a covering member being detachably coupled to the supporting member, the covering member covering the work piece; and a positioning member being detachably coupled to the base and formed with at least a protruding portion mating with the receiving slot, the protruding portion slidably received in the receiving slot, whereby the positioning member is slidable to different positions with respect to the base for abutting one end of the work piece by fixing the positioning member to the base.

* * * * *